US006717506B2

(12) United States Patent
Ishii

(10) Patent No.: US 6,717,506 B2
(45) Date of Patent: Apr. 6, 2004

(54) CHIP-TYPE RESISTOR ELEMENT

(75) Inventor: Takehiko Ishii, Moriyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/984,747

(22) Filed: Oct. 31, 2001

(65) Prior Publication Data

US 2002/0089409 A1 Jul. 11, 2002

(30) Foreign Application Priority Data

Nov. 2, 2000 (JP) ..... 2000-335552

(51) Int. Cl.[7] ..... H01C 7/10

(52) U.S. Cl. ..... 338/22 R; 338/328; 338/332; 338/22 SD

(58) Field of Search ..... 338/20, 21, 22 R, 338/22 SD, 328, 332

(56) References Cited

U.S. PATENT DOCUMENTS 4,675,644 A * 6/1987 Ott et al. ..... 338/21
4,729,058 A * 3/1988 Gupta et al. ..... 361/321.3
4,766,409 A * 8/1988 Mandai ..... 338/22 R
6,008,717 A * 12/1999 Kawase et al. ..... 338/22 R
6,184,769 B1 * 2/2001 Nakamura et al. ..... 338/21
6,188,308 B1 * 2/2001 Kojima et al. ..... 338/22 R
6,346,871 B1 * 2/2002 Ogasawara et al. ..... 338/21

FOREIGN PATENT DOCUMENTS

JP 8-250307 9/1996
JP 10-247601 9/1998

OTHER PUBLICATIONS

Kojima et al. (PCT WO99/03113) English abstract and Figs only. Jan. 21, 1999.*

* cited by examiner

*Primary Examiner*—Karl D. Easthom
(74) *Attorney, Agent, or Firm*—Keating & Bennett, LLP

(57) ABSTRACT

A laminated chip-type resistor element having minimal variations in the resistance thereof, includes a plurality of pairs of first and second inner electrodes arranged so that the tips of each of the pairs of first and second inner electrodes are opposed to each other, and the positions of gaps between the first and second inner electrodes are different in the longitudinal direction connecting first and second end surfaces. Third inner electrodes are located outside the first and second inner electrodes defining the outermost layers so as to extend further toward the inside in the longitudinal direction than the gaps, and are electrically connected the outer electrode toward the gap.

17 Claims, 5 Drawing Sheets

CHIP-TYPE RESISTOR ELEMENT

BACKGROUND OF THE INVENTION

1. Field of the Invention

The present invention relates to a chip-type resistor element such as a thermistor, and more particularly, to a laminated chip-type resistor element having a plurality of pairs of first and second inner electrodes, the tips of each of the pairs being mutually opposed with a gap interposed therebetween.

2. Description of the Related Art

Conventional chip-type thermistors have been used for temperature compensation or temperature detection. In conventional chip-type thermistor elements, various laminated chip-type thermistor elements have been proposed in order to prevent the fluctuation of electrical characteristics caused by changes in external environment (for example, see Japanese Unexamined Patent Application Publication No. 8-250307).

Also, in Japanese Patent Application No. 9-49256 (i.e., Japanese Unexamined Patent Application Publication No. 10-247601), a chip-type thermistor element shown in FIGS. 6A and 6B is disclosed.

This chip-type thermistor element 51 has a thermistor body 52 having a rectangular shape. In the thermistor body 52, a plurality of first inner electrodes 53*a* to 53*g*, and a plurality of second inner electrodes 54*a* to 54*g* are provided. The first inner electrodes 53*a* to 53*g* extend out to a first end surface 52*a*, while the second inner electrodes 54*a* to 54*g* extend out to a second end surface 52*b*. First and second outer electrodes 55 and 56 are disposed on the first and second end surfaces, respectively.

In this chip-type thermistor element 51, as shown by the inner electrodes 53*a* and 54*a* as an example, the tip of one first inner electrode and that of one second inner electrode are arranged with a gap "a" interposed therebetween. In the case of the chip-type thermistor element 51, the gaps "a" are formed at positions that are alternately different in the lamination direction. For example, the gap "a" between the first inner electrode 53*a*and the second inner electrode 54*a* defining the uppermost layer is located near the end surface 52*a*, while the gap formed at the next vertical level in the lamination direction, i.e., the gap between the inner electrode 53*b* and the inner electrode 54*b*, is formed near the end surface 52*b*.

In this manner, an attempt at reducing the resistance is made by arranging a plurality of gap positions at different locations along the lamination direction.

In addition, as shown in FIG. 6B, as compared with the inner electrodes 53*a* and 54*a* located at the uppermost portion, the inner electrodes 53*b* and 54*b* located at the next vertical position have a small dimension in the widthwise direction, thereby reducing the variations in the resistance value caused by a laminate shear that occurs between inner electrodes.

Thus, in the chip-type thermistor element 51, the positions of gaps between the first and second inner electrodes are mutually different in the longitudinal direction. More specifically, the gap "a" is located near one outer electrode 55, or near the other outer electrode 56.

As a result, the distance Z between the inner electrode 54*a* situated in the uppermost layer and the outer electrode 55 having the potential opposite to the potential of the outer electrode 56, to which the inner electrode 54*a*is connected, becomes small.

Typically, the above-described inner electrodes 53*a* to 54*g* are formed by screen-printing a conductive paste on a ceramic green sheet. The outer electrodes 55 and 56 are formed by applying a conductive paste via a dipping method, and by printing the paste. Therefore, variations of the electrode covering portions of the outer electrodes 55 and 56 in the length E are usually larger than those of the gap "a" in the longitudinal dimension.

Hence, if the distance Z in FIG. 6 approaches the longitudinal dimension of the gap "a", or becomes smaller than the longitudinal dimension of the gap "a", the contribution to the total resistance value from between the outer electrode 55 and the inner electrode 54*a* will become larger than that between the inner electrodes 53*a* and 54*a*. This raises a problem in that, as the distance Z decreases, variations of the chip-type thermistor element 51 in the resistance value increases because of variations of the covering portion of the outer electrode 55 in the longitudinal dimension E.

SUMMARY OF THE INVENTION

In order to overcome the problems described above, preferred embodiments of the present invention provide a chip-type resistor element which minimizes and eliminates variations in the resistance value caused by forming accuracy of the outer electrodes, and which has thereby very low variations in the resistance value, by improving the chip-type resistor element which is, as described above, capable of reducing the resistance value, and minimizing the variations in the resistance value caused by inter-laminate shear.

In accordance with a first preferred embodiment of the present invention, a chip-type resistor element includes a resistor body having first and second end surfaces which are opposite to each other, a plurality of first inner electrodes disposed in the resistor and extending out to the first end surface, a plurality of second inner electrodes disposed in the resistor and extending out to the second end surface, and the tip of each of which is opposed to the tip of a corresponding first inner electrode with a gap interposed therebetween, and first and second outer electrodes which cover the first and second end surfaces, respectively, and each of which has an electrode covering portion reaching the top surface, bottom surface, and a pair of side surfaces of the resistor body. In this chip-type resistor element, the positions of the gaps between the first inner electrodes and the corresponding second inner electrodes are different in the longitudinal direction, where the longitudinal direction is the direction connecting the first and second end surfaces. This chip-type resistor element also includes third inner electrodes which are disposed closer to the outside of the resistor body in the lamination direction than the first and second inner electrodes on the outermost sides in the lamination direction, which are connected to the outer electrode near the gaps between the first and second inner electrodes on the outermost sides, and which are arranged to extend to closer to the inside in the longitudinal direction than the gaps between the first and second inner electrodes on the outermost sides.

In the first preferred embodiment of the present invention, it is preferable that the chip-type resistor element in accordance with the present invention also include fourth inner electrodes, the tip of each of which is opposed to a corresponding third electrode with a gap interposed therebetween, and which are electrically connected to the outer electrode opposite to the outer electrode to which the third inner electrodes are connected.

In accordance with a second preferred embodiment of the present invention, a chip-type resistor element includes a resistor body having first and second end surfaces that are opposite with each other, a plurality of first inner electrodes disposed in the resistor and extending out to the first end surface, a plurality of second inner electrodes disposed in the resistor and extending out to the second end surface, and the tip of each of which is opposed to the tip of a corresponding first inner electrode with a gap interposed therebetween, first and second outer electrodes arranged to cover the first and second end surfaces, respectively, and each of which has an electrode covering portion extending to the top and bottom surfaces of the resistor body and a pair of side surfaces thereof. In this chip-type resistor element, the positions of the gaps between the first inner electrodes and the corresponding second inner electrodes are different in the longitudinal direction, where the longitudinal direction is the direction connecting the first and second end surfaces. Also, the gap between the first and second inner electrodes on the outermost side in the lamination direction, is located closer to the inside of the resistor body in the longitudinal direction than the inside ends of the electrode covering portions of the first and second outer electrodes.

In the chip-type resistor element in accordance with various preferred embodiments of the present invention, it is preferable that each of the first inner electrodes and a corresponding second inner electrode which is opposed to the first inner electrode with a gap interposed therebetween, be positioned on the same plane.

In the chip-type resistor element in accordance with various preferred embodiments of the present invention, it is further preferable that the resistor body be a thermistor body, and that a thermistor element be constituted of the thermistor body.

The above and other elements, characteristics, features, and advantages of the present invention will be clear from the following detailed description of preferred embodiments of the invention in conjunction with the accompanying drawing. In the drawing, like elements in each of the several figures are identified by the same reference numeral.

DETAILED DESCRIPTION OF PREFERRED EMBODIMENTS

Figure 1A:
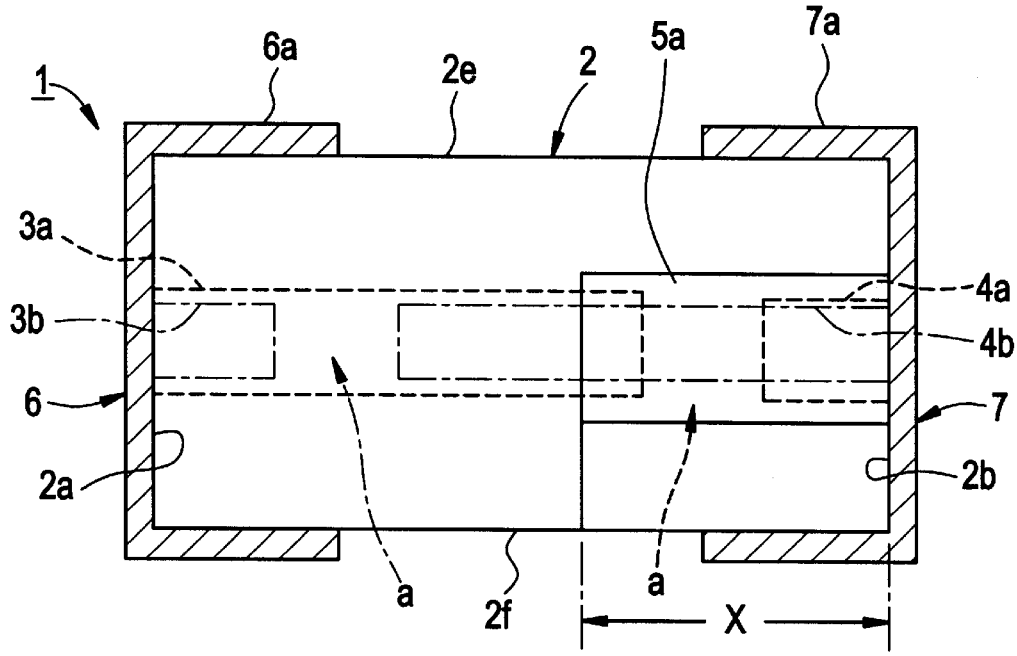
FIGS. 1A and 1B are a plan view and a longitudinal sectional view, respectively, showing a chip-type thermistor element in accordance with a first preferred embodiment of the present invention.
Figure 1B:
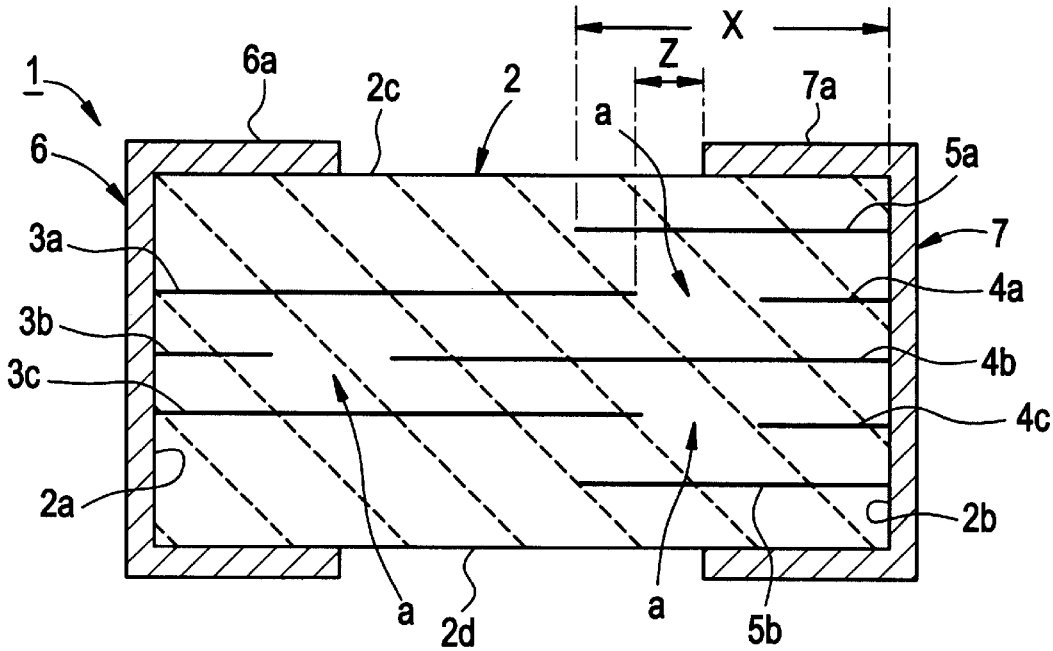
Figure 2:
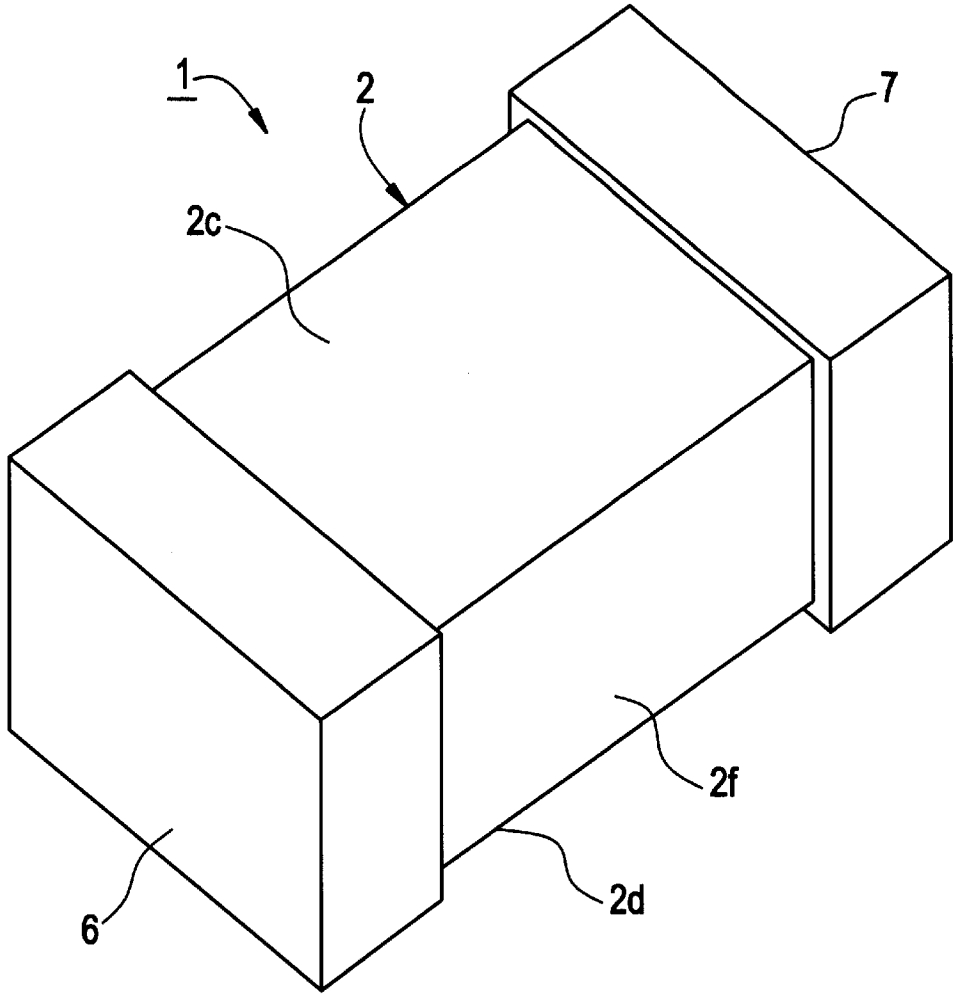
FIG. 2 is a perspective view showing the outline of a chip-type thermistor element in accordance with the first preferred embodiment of the present invention.

FIGS. 1A and 1B are a plan view and a longitudinal sectional view, respectively, showing a chip-type thermistor element 1 in accordance with a first preferred embodiment of the present invention, and FIG. 2 is a perspective view showing the outline thereof.

The chip-type thermistor element 1 preferably includes a thermistor body 2 having a substantially rectangular shape, although other shapes are possible. The thermistor body 2 is preferably made of a semiconductor ceramic having a negative resistance-temperature characteristic. The chip-type thermistor element 1, therefore, operates as a NTC thermistor.

First inner electrodes 3*a* to 3*c*, second inner electrodes 4*a* to 4*c*, and third inner electrodes 5*a* and 5*b*are provided in the thermistor body 2.

The first inner electrodes 3*a* to 3*c* are arranged to extend out to the first end surface 2*a* of the thermistor body 2. The second inner electrodes 4*a* to 4*c* are arranged to extend out to the second end surface 2*b* which is opposed to the first end surface of the thermistor body 2.

The tips of the first inner electrodes 3*a* to 3*c* and those of the second inner electrodes 4*a* to 4*c* are mutually opposed, respectively, with a predetermined gap interposed therebetween. Also, in this preferred embodiment, the inner electrodes 3*a* to 3*c* and the corresponding second inner electrodes 4*a* to 4*c* are preferably positioned on the same planes, respectively. For example, the first inner electrode 3*a* and the second inner electrode 4*a* are mutually opposed on the same plane with a gap "a" interposed therebetween.

The gaps "a" between the first inner electrodes 3*a* to 3*c* and the second inner electrodes 4*a* to 4*c* are arranged to be alternately different in the longitudinal direction. Specifically, the gap "a" between the first inner electrode 3*a* and the second inner electrode 4*a*, and the gap "a" between the first inner electrode 3*b* and the second inner electrode 4*b*, which are situated at the next vertical position, are, as shown in FIGS. 1A and 1B, located at mutually different positions in the direction connecting the first and second end surfaces 2*a* and 2*b*. Here, the direction connecting the first and second end surfaces 2*a*and 2*b* is longitudinal direction.

As shown in FIG. 1A, the first and second inner electrodes 3*a* and 4*a*, and the first and second inner electrodes 3*b* and 4*b* located below the electrodes 3*a* and 4*a*, have different structural arrangements in the width dimension. More specifically, the width of each of the first and second inner electrodes 3*a* and 4*a* is larger than that of the first and second inner electrodes 3*b* and 4*b*. Although not particularly shown, the width of each of the first and second inner electrodes 3*c* and 4*c* is also larger than that of the first and second inner electrodes 3*b* and 4*b*.

Making the widths of the first and second inner electrodes to be alternately different in the thickness direction in this manner, minimizes the variations in the resistance value caused by inter-laminate shear. In addition, alternately displacing the gaps "a" as described above allows the significant reduction in resistance to be achieved.

First and second outer electrodes 6 and 7 are arranged so as to cover the first and second end surfaces 2*a* and 2*b*. The outer electrodes 6 and 7 not only cover the end surfaces 2*a* and 2*b*, but also are arranged to extend to the top surface 2*c*, the bottom surface 2*d*, and the side surfaces 2*e*and 2*f* of the thermistor body 2. That is, the outer electrodes 6 and 7 have electrode covering portion 6*a* and 7*a*, respectively, which reaches the top surface 2*c*, bottom surfaces 2*d*, and the side surfaces 2*e* and 2*f*.

The chip-type thermistor element 1 in accordance with this preferred embodiment also preferably includes third inner electrodes 5*a* and 5*b* that are provided in addition to the above-described first and second inner electrodes 3*a* to 3*c*, and 4*a* to 4*c*.

The third inner electrodes 5*a* and 5*b* are located closer to the outside of the resistor body in the lamination direction than the portion where the first and second inner electrodes 3*a* to 4*c* are laminated. Taking the inner electrode 5*a* as an example, the inner electrode 5*a* is located closer to the outside of the resistor body in the lamination direction than the first and second inner electrodes 3*a* and 4*a* of the uppermost portion in the lamination direction, that is, the inner electrode 5*a* is located above the first and second inner electrodes 3*a* and 4*a*. The third inner electrode 5*a* extends out to the second end surface 2*b*, and is arranged so as to extend further inside in the longitudinal direction than the gap "a" between the first and second inner electrodes 3*a* and 4*a*which are situated below the third inner electrode 5*a*. In other words, the distance X from the second end surface 2*b*, to which the third electrode 5*a* is extended, to the inside end of the third inner electrode 5*a* in the longitudinal direction is larger than the distance from the end surface 2*b* to the tip of the first inner electrode 3*a* which is connected to the first outer electrode 6 opposite to the outer electrode 7 to which the third inner electrode 5*a* is connected.

The width of the third inner electrode 5*a* is preferably larger than that of the first and second inner electrodes 3*a* and 4*a*.

As shown in FIG. 1A, therefore, the third inner electrode 5*a* is arranged so that, when the gap "a" formed by the tips of the first and second inner electrodes 3*a* and 4*a*, which are opposed to each other, is projected upward, the entire region of the gap "a" is included in the third inner electrode 5*a*.

The third inner electrode 5*b* is preferably constructed in the same manner as in the third inner electrodes 5*a*, with respect to the gap "a" between the first and second inner electrodes 3*c* and 4*c*.

Since the third inner electrodes 5*a* and 5*b* have the construction and arrangement as described above, the chip-type thermistor element 1 in accordance with this preferred embodiment minimizes and eliminates variations in the resistance value, irrespective of variations of the electrode covering portions 6*a* and 7*a* in the longitudinal dimension.

As described in "Description of the Related Art" of the present application, when the outer electrodes 6 and 7 are formed by applying and printing a conductive paste, variations of the electrode covering portions 6*a* and 7*a* in the longitudinal dimension often occur.

In this preferred embodiment, however, the third inner electrode 5*a* is located above the gap "a" between the first and second inner electrodes 3*a* and 4*a* defining the uppermost layer, and electrically connected to the second outer electrode 7. Therefore, since the third inner electrode 5*a*is located between the tip of the first inner electrode 3*a*and the electrode covering portion 7*a*, and the inside end of the electrode covering portion 7*a* is located further toward the outside than the inside end of the third inner electrode 5*a*, the influence of the resistance between the electrode covering portion 7*a* and the first inner electrode 3*a* upon the resistance value of the thermistor element 1 can be substantially eliminated. Likewise, in the lower portion also, because of the presence of the third inner electrode 5*b*, the contribution of the resistance value between the electrode covering portion 7*a* and the inside end of the first inner electrode 3*c* can be substantially eliminated.

Hence, even if variations in the length occur in the electrode covering portions 6*a* and 7*a*, the variations in the resistance value of the electrode covering portions due to variations in the length thereof are effectively eliminated. It is thereby to be understood that a chip-type NTC thermistor element which has very low variations in the resistance value can be provided.

Next, the effects and a method of manufacturing the above-described chip-type thermistor element 1 will be described by explaining a specific experimental example.

First, ceramic slurry was obtained by adding a predetermined amount of an organic binder, a dispersant, a defoamer, and water to a thermistor material constituted of a plurality of ceramic oxides of Mn, Ni, and Co, or other suitable materials. Using this ceramic slurry, a ceramic green sheet having a thickness of about 40 $\mu$m was made.

Thereafter, the above-described ceramic green sheet was cut into a predetermined substantially rectangular shape, and a plurality of substantially rectangular green sheets was obtained.

A conductive paste was printed on predetermined ceramic green sheets among the plurality of ceramic green sheets so that the above-described first electrodes 3*a* to 3*c*, the second inner electrodes 4*a* to 4*c*, and the third inner electrodes 5*a* and 5*b* are each formed, and then dried. Green sheets with no electrode paste thereon were laminated on and under the ceramic green sheets on which the above-described electrode forming conductive paste had been printed. Then, this laminate was pressurized in the thickness direction, and fired to obtain the thermistor 2.

As the above-described conductive paste, a conductive paste containing Ag and Pd at a weight ratio of about 3 to about 7 was used.

A conductive paste constituted of Ag-Pd was applied to both end surfaces 2*a* and 2*b* of the thermistor body 2 obtained as described above, and was printed thereon. In addition, Ni plating layers and Sn plating layers were formed in sequence over the outer surface of both end surfaces, and thereby the first and second outer electrodes 6 and 7 were formed.

In this manner, many chip-type thermistor elements 1 were obtained, wherein seven electrode layers constituted of the first and second inner electrodes, each of the layers having approximate dimensions of 0.60 mm×0.32 mm, were laminated, and wherein the third inner electrodes 5*a* and 5*b*were formed thereabove and therebelow so as to have the following approximate value, X=0.25 mm. The longitudinal dimension of the gap "a" between the first and second inner electrodes was about 117 $\mu$m, the distance Z shown in FIG. 1B was about 85.4 $\mu$m, and the longitudinal dimension Y of the electrode covering portions 6*a* and 7*a* of the outer electrodes 6 and 7 was about 175±48 $\mu$m.

Figure 6A:
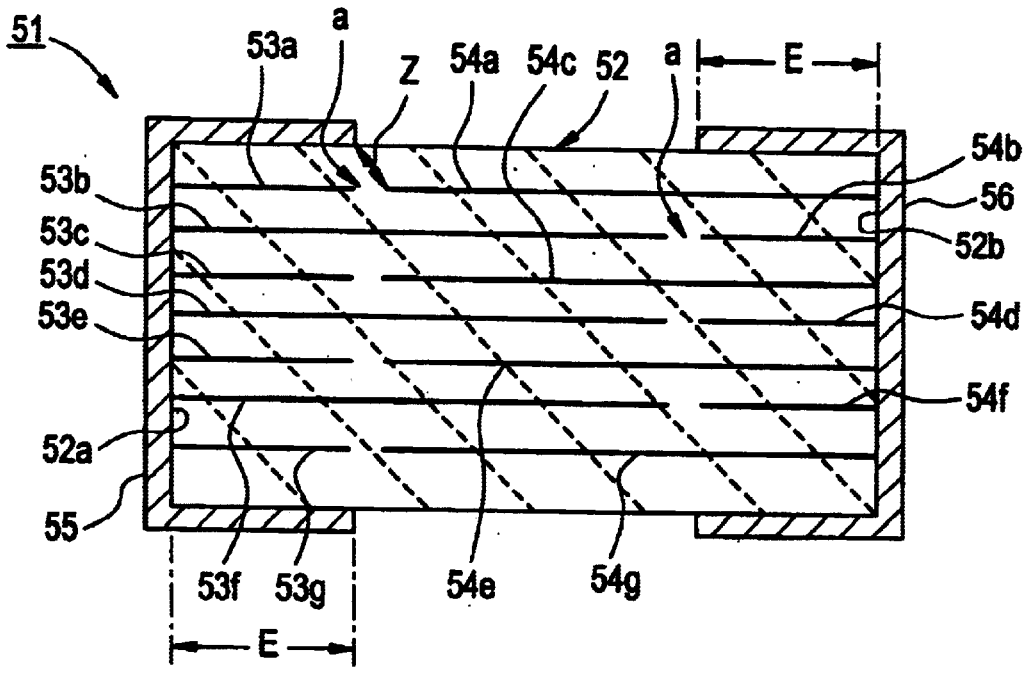
FIG. 6A PRIOR ART
FIGS. 6A and 6B are a longitudinal sectional view, and a plan view, respectively, showing a conventional chip-type thermistor element.
Figure 6B:
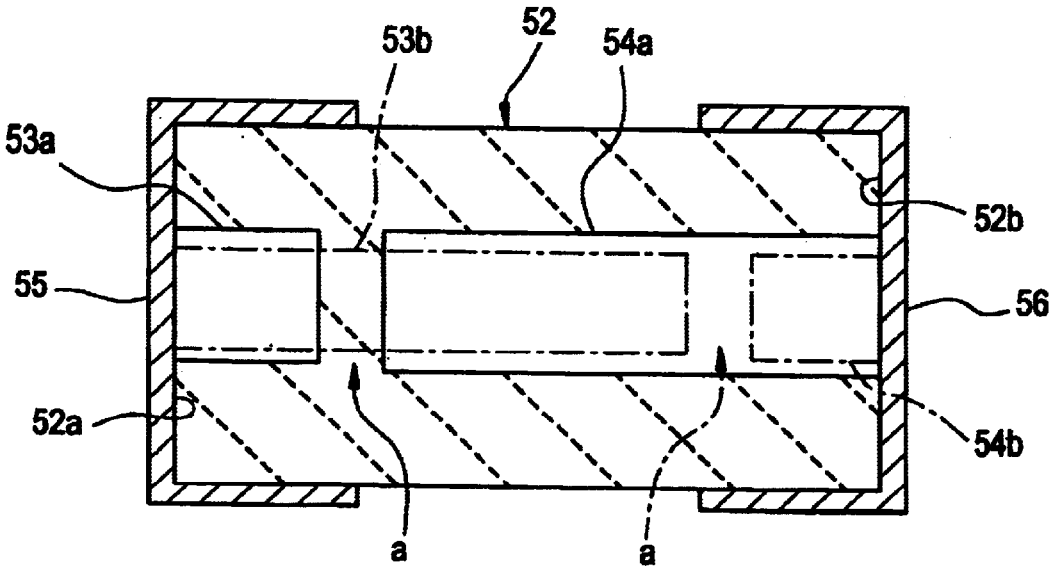
FIG. 6B PRIOR ART

For comparison, the conventional chip-type thermistor element shown in FIG. 6 was obtained in the same manner as in the above-described first preferred embodiment except that the conventional chip-type thermistor element does not include the third inner electrodes 5*a* and 5*b*. In this case, the longitudinal dimension of the gap between the first and second inner electrodes was about 120 $\mu$m, the distance Z shown in FIG. 1B was about 85.4 $\mu$m, and the dimension of the electrode covering portion of the outer electrode was about 180±42 $\mu$m.

For a hundred samples of each of the chip-type thermistor element 1 in accordance with the present preferred embodiment as prepared as described above and the conventional chip-type thermistor element 51, the resistance values and variations in the resistance value were measured. The results are shown in Table 1. Each of the resistance values in Table 1 show an average value of a hundred thermistor elements.

TABLE 1

| | First Preferred Embodiment | Conventional example |
|---|---|---|
| Number of inner electrodes | 7 | 7 |
| The third inner electrodes 5a and 5b | present | absent |
| Length of gap "a" | 117 μm | 120 μm |
| Distance between electrode covering portion 7a and the first inner electrode 3a | 85.4 μm | 85.4 μm |
| Forming accuracy Y of outer electrode covering portions | 175 ± 48 μm | 180 ± 42 μm |
| Resistance value | 4.14 kΩ | 4.6 kΩ |
| Variation in resistance value (R3CV) | 7.2% | 10.1% |

As can be seen from Table 1, the chip-type thermistor element in accordance with this preferred embodiment allows variations in the resistance value to be minimized and greatly reduced as compared to the conventional chip-type thermistor element, although the resistance value itself is reduced since the chip-type thermistor element in accordance with this preferred embodiment includes the third inner electrodes 5*a* and 5*b*. This implies that the influence of the forming accuracy of the outer electrodes 6 and 7 upon variations in the resistance value is greatly reduced so as to be negligible.

Figure 3A:
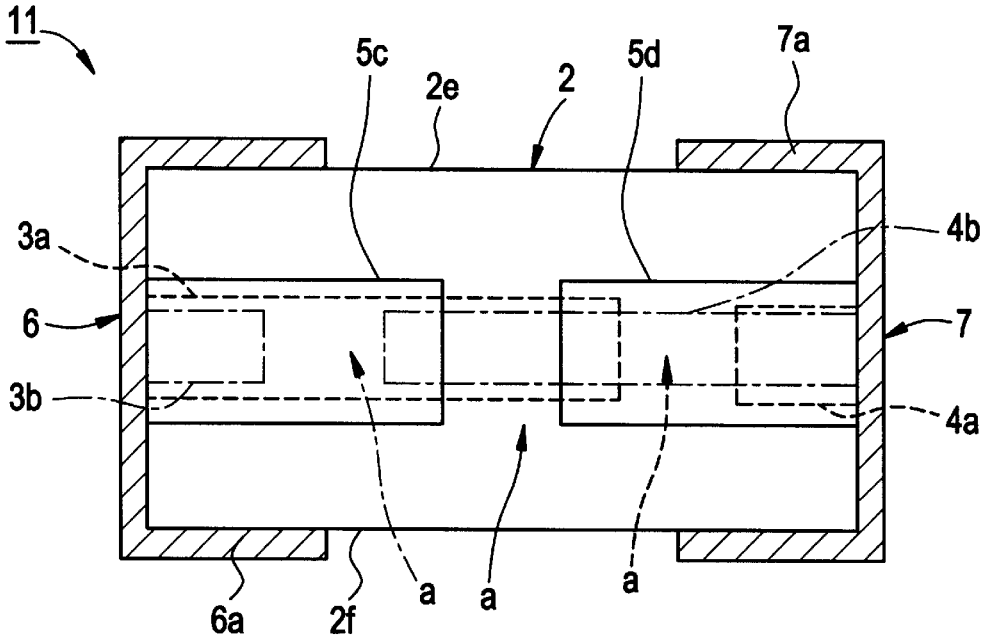
FIGS. 3A and 3B are a plan view and a longitudinal sectional view, respectively, showing a chip-type thermistor element in accordance with a second preferred embodiment of the present invention.
Figure 3B:
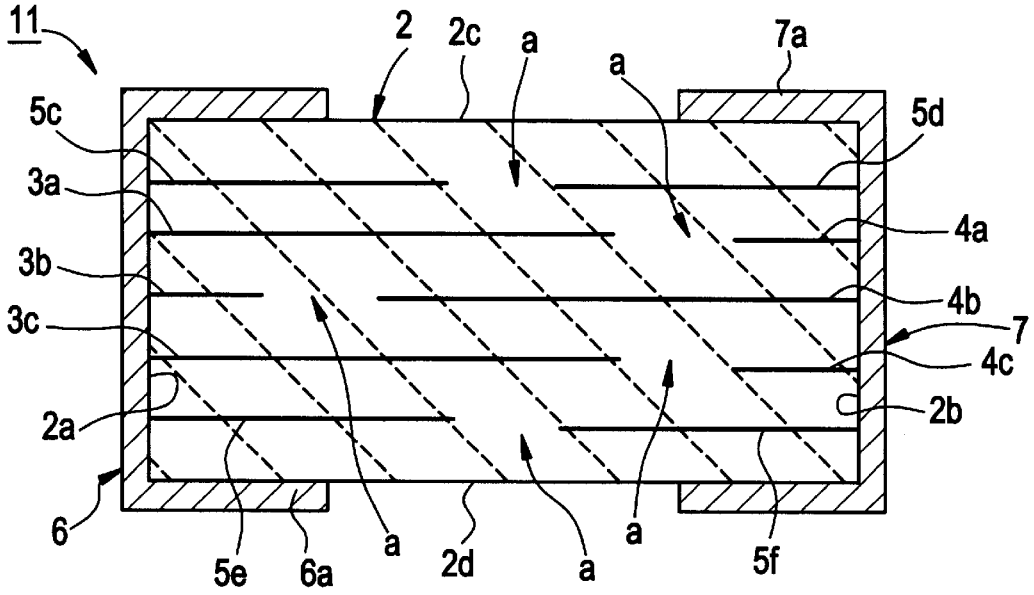

FIGS. 3A and 3B are a plan view and a longitudinal sectional view, respectively, showing a chip-type NTC thermistor element 11 in accordance with a second preferred embodiment of the present invention.

As in the case of the chip-type NTC thermistor element 1 in accordance with the first preferred embodiment, this chip-type NTC thermistor element 11 includes a thermistor body 2 having a substantially rectangular shape, the thermistor body 2 being preferably made of a semiconductor ceramic having a negative resistance-temperature characteristic. As is the case with the first preferred embodiment, the first inner electrodes 3*a* to 3*c*, and the second inner electrodes 4*a* to 4*c* are disposed in the thermistor body 2. Also, the first and second outer electrodes 6 and 7 are arranged so as to cover the first and second end surfaces 2*a* and 2*b*, and so as to include the electrode covering portions 6*a* and 7*a*.

This preferred embodiment is different from the chip-type thermistor element in accordance with the first preferred embodiment in that first and second inner electrodes 5*c*, 5*d*, 5*e*, and 5*f* are laminated closer to the outside of the resistor body than the portion where the first and second inner electrodes 3*a* to 4*c* are laminated.

For example, the inner electrodes 5*c* and 5*d* which are laminated at the uppermost portion are extended to the end surface 2*a* and 2*b*, respectively. These inner electrodes 5*c*and 5*d* located at the uppermost portion are wider than the first and second inner electrodes 3*a* and 4*a* located below the inner electrodes 5*c* and 5*d*. The gap "a" formed by the tips of the first and second inner electrodes 5*c* and 5*d*, which are opposed to each other, is positioned further inside in the longitudinal direction than the inside ends of the electrode covering portions 6*a* and 7*a*.

Since the gap "a" is thus positioned further inside in the longitudinal direction than the inside ends of the electrode covering portions 6*a* and 7*a*, the influence of variations of the electrode covering portions 6*a* and 7*a* in the longitudinal dimension upon variations in the resistance value is eliminated.

More specifically, since the inside end of the first electrode 5*c* is located further inside in the longitudinal direction than the inside end of the electrode covering portion 6*a* of the outer electrode 6, which electrode covering portion 6*a* is connected to the same potential as that of the inner electrode 5*c*, the contribution of the resistance value between the electrode covering portions 6*a*and the inside end of the second inner electrode 5*d*, which is connected to the opposite potential, can be minimized. Conversely, the contribution of the resistance value between the inside end of the electrode covering portion 7*a* and the inside end of the first inner electrode 5*c*, which is connected to the potential opposite to that of the electrode covering portion 7*a*, can also be minimized.

Likewise, in the lower portion of the thermistor body 2 also, since the gap "a" between the first and second inner electrodes 5*e* and 5*f* is positioned closer to the inside in the longitudinal direction than the inside ends of the electrode covering portions 6*a* and 7*a*, the variations in the resistance value of the electrode covering portions 6*a* and 7*a* caused by variations in the longitudinal dimension thereof are minimized.

In this manner, in the chip-type thermistor element 11 in accordance with the second preferred embodiment, wherein the plurality of pairs of first and second inner electrodes are laminated so that the longitudinal positions of the opposed gaps "a" are different from one another, since the gap "a" between the first and second inner electrodes on the outermost side in the lamination direction, is positioned closer to the inside in the longitudinal direction than the inside ends of the electrode covering portions 6*a* and 7*a* of the outer electrodes 6 and 7, the variations in the resistance value of the electrode covering portions caused by variations in the longitudinal dimension thereof are minimized, as in the case of the chip-type thermistor element in accordance with the first preferred embodiment 1.

As is clear from the comparison between the chip-type thermistor element 1 in accordance with the first preferred embodiment and the chip-type thermistor element 11 in accordance with the second preferred embodiment, the above-described second inner electrodes 5*d* and 5*f* correspond to the third inner electrodes 5*a* and 5*b* in the chip-type thermistor element 1 in accordance with the first preferred embodiment. Hence, the chip-type thermistor element 11 in accordance with the second preferred embodiment corresponds to the structure wherein, in the chip-type thermistor element 1 in accordance with the first preferred embodiment, fourth inner electrodes are arranged as inner electrodes 5*c*and 5*e* in addition to the third inner electrodes 5*a* and 5*b*, in a manner such that the tips of the fourth electrodes 5*c*and 5*e* are opposed to those of the third inner electrodes 5*a*and 5*b*, respectively, at the vertical positions where the above-described third inner electrodes 5*a* and 5*b* are located.

Next, a specific experimental example of the second preferred embodiment will be described.

A thermistor body 2 was obtained in the same manner as in the experimental example of the first preferred embodiment, but in a manner such that the inner electrodes 3*a* to 4*c*, and 5*c* to 5*f* shown in FIG. 3 are formed. The outer electrodes 6 and 7 were formed on both end surfaces of the thermistor body 2 in the same manner as in the experimental example of the first preferred embodiment. In this way, a chip-type element in accordance with the second preferred embodiment was obtained, wherein the outer dimensions were approximately 0.60 mm×0.31 mm×0.30 mm, the lamination number of inner electrodes was seven (five layers of the first and second inner electrodes were laminated between the inner electrode layer where the first and second inner electrodes 5*c* and 5*d* were formed, and the inner electrode layer where the first and second inner electrodes 5*e* and 5*f* were formed). The longitudinal dimension of the gap "a" was about 118 μm, the distance Z shown in FIG. 4 was about 85.4 μm, and the longitudinal dimension Y of the electrode covering portions 6*a* and 7*a* was about 180±45 μm.

The resistance value of the chip-type thermistor element in accordance with the second preferred embodiment, and the variation thereof in the resistance value will be shown in Table 2 below.

For comparison, in Table 2, the results of the first preferred embodiment are shown together with the results of the second preferred embodiment.

TABLE 2

| | First Preferred Embodiment | Second Preferred Embodiment |
|---|---|---|
| Number of inner electrodes | 7 | 7 |
| The third inner electrodes | present | absent |
| Length of gap "a" | 117 μm | 118 μm |
| Distance between electrode covering portion 7a and the first inner electrode 3a | 85.4 μm | 85.4 μm |
| Forming accuracy Y of outer electrode covering portions | 175 ± 48 μm | 180 ± 45 μm |
| Resistance value | 4.14 kΩ | 3.52 kΩ |
| Variation in resistance value (R3CV) | 7.2% | 4.8% |

As can be seen from Table 2, in the chip-type thermistor element accordance with the second preferred embodiment, the variation in the resistance value caused by the outer electrode forming accuracy becomes smaller than in the case of the chip-type thermistor element accordance with the first preferred embodiment, although the resistance value thereof itself becomes smaller than that of the chip-type thermistor element accordance with the first preferred embodiment.

Figure 4:
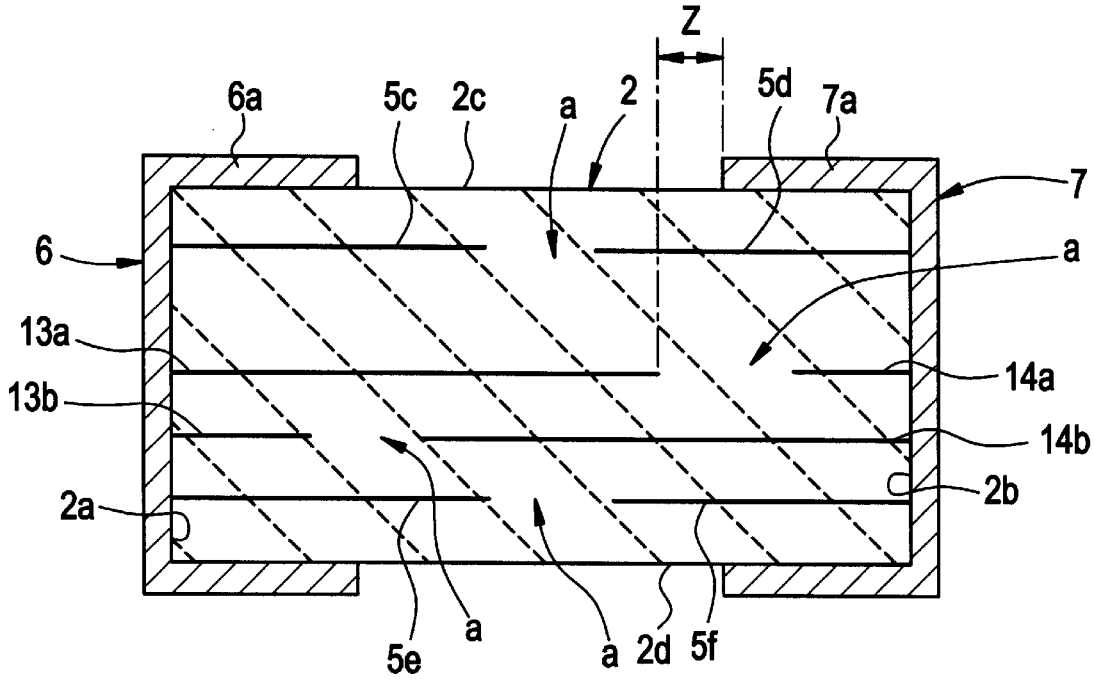
FIG. 4 is a longitudinal sectional view showing a modification of the chip-type thermistor element in accordance with the second preferred embodiment of the present invention.

FIG. 4 is a longitudinal sectional view showing a modification of the chip-type thermistor element 11 in accordance with the second preferred embodiment. Herein, two layers of first and second inner electrodes 13*a*, 13*b*, 14*a*, and 14*b* are located between the layer where the first and second inner electrodes 5*c* and 5*d* defining the outermost layer are located, and the layer where the inner electrodes 5*e* and 5*f* are located. In such a manner, the lamination number of inner electrodes may be arbitrarily changed.

Figure 5:
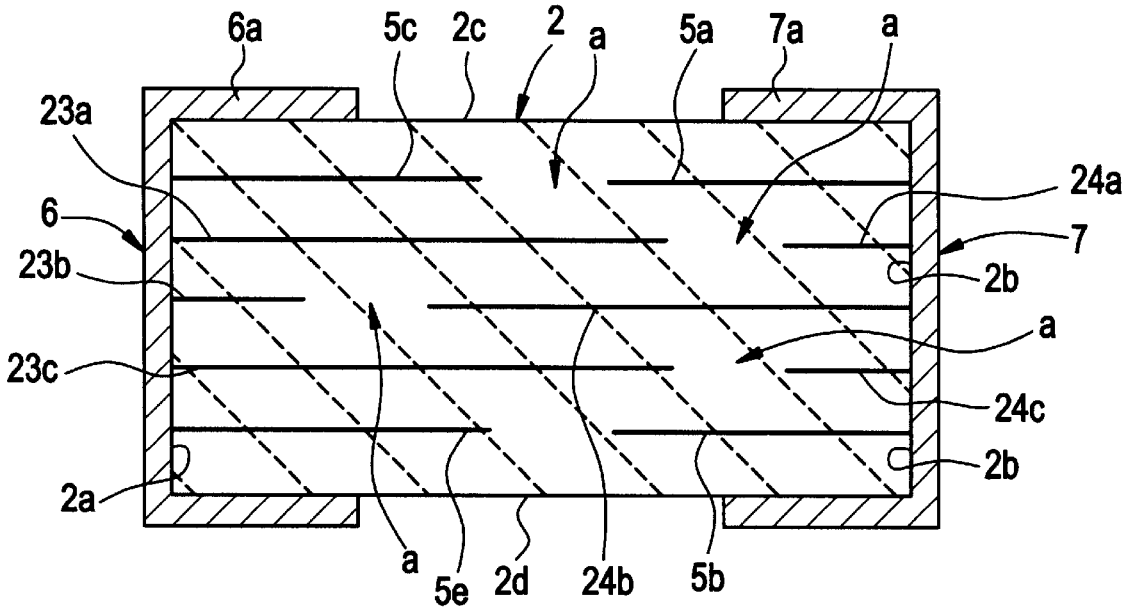
FIG. 5 is a longitudinal sectional view showing a modification of the chip-type thermistor element in accordance with the first preferred embodiment of the present invention.

FIG. 5 is a longitudinal sectional view showing a modification of the chip-type thermistor element 1 in accordance with the first preferred embodiment of the present invention. First and second inner electrodes 23*a* to 23*c*, and 24*a* to 24*c* are disposed in the ceramic sintered body 2. Herein, the third inner electrode 5*b* located below these first and second inner electrodes is located near the second end surface 2*b*. This is because the gap between the first and second inner electrodes 23*c* and 24*c* defining the lowermost layer, is located near the second end surface 2*b*. In this way, in the chip-type thermistor element in accordance with the first preferred embodiment, on the side of the end surface located near where the gap "a" between the first and second inner electrodes on the outermost side in the lamination direction is formed, a third inner electrode which extends to the above-described end surface is disposed, and thereby, the variations in the resistance value of the electrode covering portions caused by variations in the longitudinal dimension thereof can be minimized as described above regarding the first preferred embodiment.

The modification shown in FIG. 5 has the inner electrodes 5*c* and 5*e* extending out to the end surface 2*a*, and the gap between the inner electrodes 5*c* and 5*a*, and that between the inner electrodes 5*e* and 5*b* are each positioned closer to the inside in the longitudinal direction than the inside ends of the electrode covering portions 6*a* and 7*a*. Therefore, this modification is also a modification of the second preferred embodiment.

In the first and second preferred embodiments and the above-described modifications thereof, description has been made of chip-type NTC thermistor elements, but in the present invention, a PTC thermistor element may be formed, using a semiconductor ceramic having a positive resistance-temperature characteristic.

Moreover, the present invention can be applied to not only a thermistor element, but also to various chip-type resistor elements such as laminated chip-type fixed-resistance elements, chip-type laminated varistors, and other elements, wherein the tips of each of pairs of first and second inner electrodes are disposed mutually oppositely.

As is evident from the foregoing, in the chip-type resistor element in the first preferred embodiment of the present invention, the third inner electrodes are disposed closer to the outside of the resistor body in the thickness direction than the first and second inner electrodes on the outermost side so as to extend further toward the inside in the longitudinal direction than the resistance gaps between the first and second inner electrodes on the outermost sides. This means that, between the gaps between the first and second inner electrodes as the outermost layers and the outer electrode toward these gaps, third inner electrodes having the same potential as that of this outer electrode are disposed. Therefore, even if the dimensions of the electrode covering portions of the outer electrode vary, the variations in the resistance value thereof caused by the variations in the dimensions thereof are reliably eliminated and minimized. This allows a chip-type resistor element which has minimal and greatly reduced variations in the resistance value as compared to conventional chip-type resistor elements to be provided.

When the fourth inner electrodes are arranged so that the tips thereof are each opposed to those of the third inner electrodes, the variations in the resistance value of the outer electrode covering portions caused by variations in the length thereof are more reduced.

In the chip-type resistor element in the second preferred embodiment of the present invention, since the gaps between the first and second inner electrodes defining the outermost layers are located closer to the inside in the direction connecting the first and second end surfaces than the inside ends of the first and second outer electrodes, the variations in the resistance value of the electrode covering portions of the first and second outer electrodes caused by variations in the longitudinal dimensions thereof are minimized. This allows a chip-type resistor element which has minimal variations in the resistance value to be provided, as in the case of the first preferred embodiment.

In the present invention, when the pair of first and second inner electrodes are located on the same plane, the printing process of the first and second inner electrodes is greatly simplified wherein the inner electrode paste is printed on ceramic green sheets, and wherein a plurality of ceramic green sheets is laminated and fired.

In the present invention, when the thermistor body is used as a resistor body, a chip-type thermistor element which has very variations in the resistance value can be provided in accordance with various preferred embodiments of the present invention.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications that fall within the true spirit and scope of the invention.

What is claimed is:

1. A chip-type resistor element, comprising:

a resistor body having-a first and second end surfaces arranged opposite to each other, and a top surface, a bottom surface and a pair of side surfaces;

a plurality of first inner electrodes disposed in said resistor body and extending out to said first end surface;

a plurality of second inner electrodes disposed in said resistor body and extending out to said second end surface, and a tip of each of the plurality of second inner electrodes being opposed to a tip of a corresponding one of the plurality of first inner electrodes with a gap interposed therebetween;

first and second outer electrodes arranged to cover said first and second end surfaces, respectively, and each of which has an electrode covering portion extending to the top surface, the bottom surface and the pair of side surfaces of said resistor body;

the positions of the gaps between said first inner electrodes and the corresponding second inner electrodes being different in a longitudinal direction, where the longitudinal direction is the direction connecting said first and second end surfaces; and third inner electrodes disposed further outside of the resistor body in a lamination direction than the first and second inner electrodes on the outermost sides in the lamination direction, the third inner electrodes being connected to the outer electrode near the gap between said first and second inner electrodes on said outermost sides, and the third inner electrodes being arranged so that the third inner electrode tips are not aligned in the lamination direction with the tips of said first and second inner electrodes of either of said first inner electrode and said second inner electrode.

2. A chip-type resistor element in accordance with claim 1, further comprising fourth inner electrodes being arranged such that the tip of each of the fourth inner electrodes is opposed to a corresponding third electrode with a gap interposed therebetween, the fourth inner electrodes being electrically connected to the outer electrode opposite to the outer electrode to which said third inner electrodes are connected.

3. A chip-type resistor element in accordance with claim 1, wherein each of the first inner electrodes and a corresponding one of the second inner electrodes which is opposed to said first inner electrode with a gap interposed therebetween, are positioned on the same plane.

4. A chip-type resistor element in accordance with claim 1, wherein said resistor body is a thermistor body, and wherein the thermistor body defines a thermistor element.

5. A chip-type resistor element in accordance with claim 1, wherein widths of the first and second inner electrodes are different alternately in the thickness direction.

6. A chip-type resistor element in accordance with claim 1, wherein the width of the third inner electrode is greater than widths of the first and second inner electrodes.

7. A chip-type resistor element in accordance with claim 1, wherein said resistor body is a thermistor body made of a semiconductor ceramic having a negative resistance-temperature characteristic.

8. A chip-type resistor element in accordance with claim 1, wherein said resistor body is a thermistor body made of a semiconductor ceramic having a positive resistance-temperature characteristic.

9. A chip-type resistor element in accordance with claim 1, wherein said resistor body defines one of a thermistor element, a laminated chip-type fixed-resistance element and a chip-type laminated varistor.

10. A chip-type resistor element, comprising:

a resistor body having a-first and second end surfaces arranged opposite to each other, and a top surface, a bottom surface and a pair of side surfaces;

a plurality of first inner electrodes disposed in said resistor body and extending out to said first end surface;

a plurality of second inner electrodes disposed in said resistor body and extending out to said second end surface, and a tip of each of the plurality of second inner electrodes being opposed to a tip of a corresponding one of the plurality of first inner electrodes with a gap interposed therebetween;

first and second outer electrodes arranged to cover said first and second end surfaces, respectively, and each of which has an electrode covering portion extending to the top surface, the bottom surface and the pair of side surfaces of said resistor body;

the positions of the gaps between said first inner electrodes and the corresponding second inner electrodes being different in a longitudinal direction, where the longitudinal direction is the direction connecting said first and second end surfaces; and the gaps between said first and second inner electrodes on the outermost sides of the resistor body in a lamination direction being positioned further inside of the resistor body in the longitudinal direction than the inside ends of the electrode covering portions of the first and second outer electrodes, such that both ends of the gaps are spaced further inside of the resistor body in the longitudinal direction than the inside ends of the electrode covering portions of the first and second outer electrodes.

11. A chip-type resistor element in accordance with claim 10, wherein each of the first inner electrodes and a corresponding one of the second inner electrodes which is opposed to said first inner electrode with a gap interposed therebetween, are positioned on the same plane.

12. A chip-type resistor element in accordance with claim 10, wherein said resistor body is a thermistor body, and wherein the thermistor body defines a thermistor element.

13. A chip-type resistor element in accordance with claim 10, wherein widths of the first and second inner electrodes are different alternately in the thickness direction.

14. A chip-type resistor element in accordance with claim 10, wherein said resistor body is a thermistor body made of a semiconductor ceramic having a negative resistance-temperature characteristic.

15. A chip-type resistor element in accordance with claim 10, wherein said resistor body is a thermistor body made of a semiconductor ceramic having a positive resistance-temperature characteristic.

16. A chip-type resistor element in accordance with claim 10, wherein said resistor body defines one of a thermistor element, a laminated chip-type fixed-resistance element and a chip-type laminated varistor.

17. A chip-type resistor element in accordance with claim 1, wherein the third inner electrodes are not opposed to any other electrodes in the resistor body.

* * * * *